US007070269B2

(12) United States Patent
Tanikawa et al.

(10) Patent No.: US 7,070,269 B2
(45) Date of Patent: Jul. 4, 2006

(54) RECORDING METHOD AND APPARATUS WITH AN INTERMEDIATE TRANSFER MEDIUM BASED ON TRANSFER-TYPE RECORDING MECHANISM

(75) Inventors: Kiyoshi Tanikawa, Kanagawa (JP); Tadashi Saito, Kanagawa (JP); Aino Noguchi, Kanagawa (JP); Yasuo Katano, Kanagawa (JP); Kakuji Murakami, Kanagawa (JP); Mitsuo Hasebe, Tokyo (JP); Toshio Kawakubo, Kanagawa (JP); Satoru Tomita, Kanagawa (JP); Tomoko Takahashi, Kanagawa (JP); Nobuyuki Yanagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/993,904

(22) Filed: Nov. 19, 2004

(65) Prior Publication Data

US 2005/0068398 A1 Mar. 31, 2005

Related U.S. Application Data

(62) Division of application No. 10/648,111, filed on Aug. 26, 2003, now Pat. No. 6,837,578, which is a division of application No. 09/442,869, filed on Nov. 18, 1999, now Pat. No. 6,623,816.

(30) Foreign Application Priority Data

Nov. 18, 1998 (JP) ..... 10-327786
Nov. 26, 1998 (JP) ..... 10-335079
Nov. 27, 1998 (JP) ..... 10-336741

(51) Int. Cl.
*B41J 2/01* (2006.01)

(52) U.S. Cl. ..... 347/103; 347/101

(58) Field of Classification Search ..... 347/103, 347/101, 105, 96, 100, 3; 399/1; 400/1
See application file for complete search history.

(56) References Cited

U.S. PATENT DOCUMENTS

| | | | | |
|---|---|---|---|---|
| 4,088,800 | A | 5/1978 | Nicholson | 427/8 |
| 4,538,156 | A | 8/1985 | Durkee et al. | 346/21 |
| 4,598,302 | A | 7/1986 | Swidler et al. | 346/76 PH |
| 5,099,256 | A | 3/1992 | Anderson | 346/1.1 |
| 5,175,568 | A | 12/1992 | Oyamaguchi et al. | 346/151 |
| 5,177,506 | A | 1/1993 | Katano | 346/151 |
| 5,200,762 | A | 4/1993 | Katano et al. | 346/76 R |
| 5,278,126 | A | 1/1994 | Katano et al. | 503/201 |

(Continued)

FOREIGN PATENT DOCUMENTS

EP 0 805 049 5/1997

(Continued)

*Primary Examiner*—Manish S. Shah
(74) *Attorney, Agent, or Firm*—Greenberg, Traurig, LLP; Joseph M. Manak; Eugene C. Rzucidlo

(57) ABSTRACT

An apparatus and method for recording an image using a transfer-type recording mechanism are such that a layer of an intermediate transfer element is removably formed on a surface of an intermediate transfer medium. The intermediate transfer element includes an ultraviolet stabilizer and a powder mixture. The intermediate transfer layer is capable of being dissolved and swelled by applying an ink liquid on the intermediate transfer medium and enables a viscosity of the ink liquid residing thereon to be increased. An image is produced on the intermediate transfer medium by supplying the ink liquid thereon. The image is then transferred to the recording medium, so that a high quality image is produced without any blurring, mixing or penetration of the ink liquid.

10 Claims, 3 Drawing Sheets

U.S. PATENT DOCUMENTS

| | | | | |
|---|---|---|---|---|
| 5,335,001 | A | 8/1994 | Katano | 346/76 R |
| 5,352,652 | A | 10/1994 | Ito et al. | 428/327 |
| 5,369,421 | A | 11/1994 | Tomono et al. | 346/76 R |
| 5,371,059 | A | 12/1994 | Hirano et al. | 503/227 |
| 5,436,642 | A | 7/1995 | Oyamaguchi et al. | 347/221 |
| 5,471,234 | A | 11/1995 | Katano et al. | 347/171 |
| 5,790,160 | A * | 8/1998 | Reeves et al. | 347/103 |
| 5,876,898 | A | 3/1999 | Ikeda et al. | 430/203 |
| 6,084,620 | A | 7/2000 | Morikawa et al. | 347/96 |
| 6,108,021 | A | 8/2000 | Morikawa et al. | 347/221 |
| 6,396,528 | B1 * | 5/2002 | Yanagawa | 347/213 |
| 6,439,713 | B1 | 8/2002 | Noguchi et al. | 347/103 |

FOREIGN PATENT DOCUMENTS

| | | |
|---|---|---|
| JP | 32-4141 | 0/1957 |
| JP | 54-68303 | 6/1979 |
| JP | 60-230672 | 11/1985 |
| JP | 10-58664 | 3/1987 |
| JP | 62-92846 | 4/1987 |
| JP | 02-262688 | 10/1990 |
| JP | 03-016734 | 1/1991 |
| JP | 3-55283 | 3/1991 |
| JP | 5-200999 | 8/1993 |
| JP | 7-89067 | 4/1995 |
| JP | 7-145576 | 6/1995 |
| JP | 09-131972 | 5/1997 |
| JP | 09-169157 | 6/1997 |
| JP | 09-323474 | 12/1997 |
| JP | 11-188858 | 7/1999 |
| JP | 2000-158794 | 6/2000 |

* cited by examiner

RECORDING METHOD AND APPARATUS WITH AN INTERMEDIATE TRANSFER MEDIUM BASED ON TRANSFER-TYPE RECORDING MECHANISM

CROSS-REFERENCE TO RELATED APPLICATIONS

This is a divisional application of U.S. application Ser. No. 10/648,111 filed Aug. 26, 2003 now U.S. Pat. No. 6,837,578, the disclosure of which is hereby fully incorporated by reference and which is a divisional application of U.S. application Ser. No. 09/442,869 filed Nov. 18, 1999, now U.S. Pat. No. 6,623,816 B1, the disclosure of which is hereby fully incorporated by reference.

BACKGROUND OF THE INVENTION

The present invention generally relates to a recording method and apparatus using a liquid printing device. More particularly, the present invention is directed to a transfer-type recording mechanism in which a liquid printing device prints a recording liquid on a layer of an intermediate transfer element provided on an intermediate transfer medium in response to an imaging signal to form an image on the layer of the intermediate transfer element, and then the image is transferred to a recording medium.

A recording method using an ink jet recording device, in which a recording liquid containing a color agent, usually referred to as ink, is emitted as a droplet under control of an image signal representative of information to be printed as so to achieve recording of an image, is advantageous in that a structure of the ink jet recording device is comparatively simple and that a noise generated by its recording operation can be reduced to an almost negligible amount. However, printing quality problems associated with producing images directly on a recording medium using ink jet technology include variations in printing conditions and quality depending on a type of a recording medium, such as an overhead projector sheet, a synthetic paper, an ink jet-dedicated paper or other recording media. In addition, when printing on plain paper with a typical water-soluble ink, deterioration of printing resolution occurs because of ink liquid blur and ink liquid penetration problems (i.e., the ink liquid penetrates through the plain paper to a back surface of the plain paper) due to ink liquid migration through paper fibers. Further, there is another problem that a printed image which is not dried fully is degraded when the recorded medium is ejected from a recording apparatus.

A recording method designed to solve the above-mentioned problems is described in U.S. Pat. Nos. 4,528,156 and 5,099,256. This method is a so-called intermediate transfer method in which, first an ink image is produced on an intermediate transfer medium via an ink jet recorder, and then the ink image on the intermediate transfer medium is transferred from the transfer medium to a recording medium. Such an intermediate transfer method includes a significant feature that a recording head is arranged at a predetermined spacing between the recording head and the recording medium so as to prevent clogging of the recording head caused by contamination due to paper fragments and dust. However, when an ink liquid is printed on the transfer medium, the ink liquid spreads inadequately, flows and mixes when producing a multicolor image, thereby producing an inaccurate image. This phenomenon is herein referred to as "ink liquid crawling".

In order to solve the above problems, Japanese Laid-Open Patent Application No. 62-92849 describes a transfer method in which, first an ink liquid is printed on an intermediate transfer medium, a large portion of a water content of the ink liquid formed thereon is evaporated to produce a condensed ink liquid, which is in turn transferred to a recording medium. This method has an advantageous affect that a vivid image can be obtained, but is not applicable to a high-speed recording, energy-saving and high-resolution recording system because frequently, thermal energies and devices are required for generating the condensed ink on the transfer medium.

Japanese Laid-Open Patent Application No. 3-55283 teaches another method based on the intermediate transfer method, in which an ejected ink provided on an ink transfer medium is cooled partially so as to solidify the ink and to achieve a recording. A local cooling of the ejected ink induces a formation of high viscosity of the ink which can be transferred to a recording medium.

Japanese Laid-Open Patent Application No. 5-200999 describes another method in which an ink liquid is printed on a transfer drum which includes a water-absorptive layer on its surface. A water content of the ink liquid is absorbed by the water-absorptive layer due to its high absorption ability so as to form a condensed ink thereon, and then it is transferred to a recording medium. An advantage of this method is that a vivid image formation can be accomplished, because only the condensed ink formed on the water-absorptive layer by absorbing water contained in the ink liquid can be transferred to the recording medium.

Like Japanese Laid-Open Patent Application No. 62-92849, the above two methods are not suitable for high-speed printing, the energy-saving and the high resolution printing system as well as a compact and a light apparatus, because of the same reasons described with respect to Japanese Laid-Open Patent Application No 62-92849.

Japanese Laid-Open Patent Application No. 7-89067 discloses another method based on an ink jet recording method, which permits a transfer efficiency and image formation to be improved. An ink droplet is discharged on an intermediate transfer layer having a surface carrying a surfactant for improving wetability to form an image thereon, which is in turn transferred to a recording medium. In general, a typical surface active agent has an inherent property that reduces surface tension of a solution. When a water-based ink droplet used in the ink jet recording method is discharged on such a layer, it is natural that reduction of surface tension between the ink droplet and the above layer occurs, thereby causing spreading of the ink droplet thereon. In other words, there is a disadvantage in that it is difficult to obtain a high resolution image with good sharpness because an overall dimension of the ink liquid is likely to spread on the layer coated by the surfactant in comparison with an ink liquid size ejected from a recording head. Moreover, since the ink liquid is transferred to a recording medium together with the surface active agent, an additional disadvantage is that ink liquid bleeding occurs due to co-penetration of the ink liquid and the surface active agent into the recording medium, such as a paper.

Japanese Laid-Open Patent Application No. 7-145576 describes a specialized ink with which a printing quality is independent of the type of a recording medium, and a transfer medium from which only an image part is separated. Because transfer based on this type is carried out at temperature of from about 200° C. to about 300° C. as a softening temperature of a separating layer, there is provided a problem of d high-speed recording and system reliability.

Japanese Laid-Open Patent Application No. 10-58664 discloses still another method in which an ink liquid containing a dye having a quaternary ammonium salt in the side chain is printed on an anionic ion-exchange resin layer on the uppermost layer of an intermediate transfer medium using an ink jet generator, and the ink liquid is modified through chemical action during transportation of the transfer medium and transferred to a recording medium. This method provides an advantage that a transfer efficiency can be improved. On the other hand, this method has a drawback in that, because of ion-exchangeable modification of a dye composition in the ink liquid with the ion-exchange resin layer, a color tone of the ink on the recording medium is changed subtly. Generally speaking, since the ion-exchange resin layer functions such that only an ion can be exchanged with another one and does not absorb water contained in ink liquids, the only dye composition of the ink liquid printed on the ion-exchange resin layer is subjected to chemical modification. Because a concentration of the ink liquid remains constant, the ink is transferred to the recording medium, thereby producing a problem that a transferred image experiences ink liquid blurring, penetration problems and color mixing. In addition, since an ammonia gas is generated upon heating the ion-exchange resin layer for reuse, there is provided a pollution problem. Additionally, this method does not meet the requirement for a high-speed printing, low energy consumption, high resolution printing, compact and light system with maintenance-free operation due to deterioration and reuse and the like for the ion-exchange resin layer.

Japanese Laid-Open Patent Application No. 11-188858 by the present applicant discloses a recording method and apparatus which use an intermediate transfer medium having a powder layer which is removably provided on the transfer medium to receive a liquid from a printing head. In this recording method, the liquid is emitted in response to an image signal to produce an image on the intermediate transfer medium, and then the image thereon is transferred to a recording medium. The powder layer is formed of a polymer powder with high water-absorbing ability, and is dissolvable and swellable by the liquid and causes an increase in viscosity of the liquid residing thereon prior to transfer to a final recording medium. However, this has a problem that there are required a dedicated cleaning members, such as a blade and a brush or the like for cleaning the unused powder remaining on the intermediate transfer medium after transfer to the recording medium.

In general, since an area of a background portion of the intermediate transfer medium is larger than that of an imaged part, a quantity of the powder for use in this type tends to become large. Additionally, when the powder in an unused state is allowed to stand for a long time, the powder on the intermediate transfer medium absorbs water to cause viscosity of the powder to be increased, thereby leading to occurrence of a problem that the powder having water absorbed can not be cleaned by the cleaning member.

Moreover, properties such as water resistance and light resistance for a dye-based ink liquid is usually inferior to that for a pigment-based ink liquid, although images formed by the former have high chroma and vivid color tones. Japanese Laid-Open Patent Application No. 54-68303 describes an ink liquid containing an aqueous organic ultraviolet stabilizer. However, this ink liquid causes a clogged recording head problem and another disadvantage in that ejection stability is unsatisfactory for the ink jet recording method in which the ink droplet is ejected.

The foregoing patents solve some problems associated with the ink jet recording which produces images on the recording medium, but the major problems of image feathering, color to color blur and liquid penetration have not been solved.

BRIEF SUMMARY OF THE INVENTION

To overcome the problems described above, preferred embodiments of the present invention provide a recording method and apparatus based on a transfer-type recording mechanism, in which an unused powder after a transfer step is reused and a quantity of powder for use is limited to that used in an imaged area, and only deteriorated powder due to absorption of a moisture in air can be removed.

In one preferred embodiment of the present invention, a method of recording an image includes the steps of forming a layer of an intermediate transfer element removably on a surface of an intermediate transfer medium, the surface of the intermediate transfer medium having a substance which reacts with the intermediate transfer element, the layer being dissolvable and swellable by a liquid on the intermediate transfer medium and enabling a viscosity of the liquid residing thereon to be increased; producing an image on the intermediate transfer medium by supplying the liquid thereon from a recording head in response to an image signal; and transferring the image to a recording medium, wherein the intermediate transfer element remains on the intermediate transfer medium after transfer and is reused without removal.

According to another preferred embodiment of the present invention, an apparatus for recording an image includes a recording head for projecting a liquid; an intermediate transfer medium; a recording medium; and a layer of an intermediate transfer element formed removably on a surface of the intermediate transfer medium, the surface of the intermediate transfer medium formed of a substance which reacts with the intermediate transfer element, the layer being dissolvable and swellable by the liquid supplied on the intermediate transfer medium from the recording head in response to an image signal and enabling a viscosity of the liquid residing thereon to be increased so as to produce an image which is in turn transferred to the recording medium; and a cleaning member including a surface which has a poor releasing ability for the intermediate transfer element having an increased viscosity caused by the liquid or absorption of a moisture in air in comparison with the surface of the intermediate transfer medium, and the intermediate transfer element having the increased viscosity is removed from the intermediate transfer medium by contacting the cleaning member with the surface of the intermediate transfer medium after transfer to the recording medium.

Preferred embodiments of the present invention provides a recording method and apparatus in which only quantity of an intermediate transfer element consumed by a liquid can be supplied on an intermediate transfer medium so as to reuse the intermediate transfer element which is remaining on the medium, so that simplification of the apparatus and low cost operation due to reduction of the quantity of the intermediate transfer element can be realized.

Also, preferred embodiments of the present invention provide a recording method and apparatus based on a transfer-type recording mechanism having an intermediate transfer medium in order to improve a high-speed recording using a recording medium and light resistance of an image produced on the recording medium. A vivid image is instantaneously formed on the intermediate transfer medium so that the image is then transferred to a recording medium so as to produce an excellent transferred image with light and water resistance properties while eliminating liquid blur, color mixing and liquid penetration problems.

According to preferred embodiments of the present invention, there is provided a recording method and apparatus which prevent image blur due to liquid crawling and penetration problems of a transferred image on a recording medium using an intermediate transfer medium having a surface which has a water-absorptive layer for an ink liquid and exhibits an increased viscosity caused by water absorption, and improve light resistance of the transferred image by containing an ultraviolet stabilizer in the layer provided on the intermediate transfer medium, and eliminate recording head clogging because of inclusion of the ultraviolet stabilizer in the liquid.

According to a preferred embodiment of the present invention, there is provided a recording method in which an image on an intermediate transfer medium is produced by supplying a liquid thereon in response to an image signal, and the image is then transferred to a recording medium so as to record an image, the method including the steps of forming a layer of an intermediate transfer element removably on a surface of the intermediate transfer medium, the intermediate transfer element including a powder having a water-absorptive ability for the liquid and exhibiting an increased viscosity caused by water absorption and an ultraviolet stabilizer, the layer being dissolvable and swellable by the liquid on the surface of the intermediate transfer medium and enabling a viscosity of the liquid residing thereon to be increased; producing the image on the intermediate transfer medium by supplying the liquid on the surface of the intermediate transfer medium; and transferring the image on the intermediate transfer medium to the recording medium.

According to another preferred embodiment of the present invention, there is provided a recording apparatus in which an image on an intermediate transfer medium is produced by supplying a liquid thereon in response to an image signal, and then the image is then transferred to a recording medium so as to record an image, the apparatus including a forming portion for forming a layer of an intermediate transfer element on a surface of the intermediate transfer medium, the intermediate transfer element including a powder and an ultraviolet stabilizer, the layer being disposed removably on the intermediate transfer medium, the layer being dissolvable and swellable by the liquid on the intermediate transfer medium and enabling a viscosity of the liquid thereon to be increased; a liquid supplying portion for supplying the liquid on the intermediate transfer medium having a surface has the layer so as to produce the image thereon; and a transfer portion for transferring the image formed on the transfer medium to the recording medium.

According to preferred embodiments of the present invention, a high quality image having excellent sharpness and light resistance can be produced while suppressing ink liquid blur on a recording medium significantly.

It is still another preferred embodiment of the present invention, an improved recording method and apparatus is compact, light and energy-saving and based on transfer-type recording mechanism.

According to another preferred embodiment of the present invention, there is provided a recording method in which an image on an intermediate transfer medium is produced by supplying a liquid thereon from a recording head in response to an image signal and the image is then transferred to a recording medium, the recording method including the steps of forming a layer of an intermediate transfer element removably on a surface of the intermediate transfer medium, the intermediate transfer element formed of a powder mixture including a plurality of powders, each of which having different chemical and physical properties, the layer being dissolvable and swellable by the liquid on the intermediate transfer medium and enabling a viscosity of the liquid residing thereon to be increased; producing an image on the intermediate transfer medium by supplying the liquid thereon; and then transferring the image to the recording medium.

According to another preferred embodiment of the present invention, there is provided a recording apparatus including a recording head for projecting a liquid, an intermediate transfer medium and a recording medium, the liquid is supplied on the intermediate transfer medium from the recording head so as to produce an image thereon which is in turn transferred to the recording medium, the apparatus including a forming portion for forming a layer of an intermediate transfer element on a surface of the intermediate transfer medium, the intermediate transfer element including a powder mixture including a plurality of powders each having different chemical and physical properties, the layer formed removably on the intermediate transfer medium, the layer being dissolvable and swellable by the liquid on the intermediate transfer medium and enabling a viscosity of the liquid thereon to be increased, a liquid supplying portion for supplying the liquid on the intermediate transfer medium having a surface which includes a layer for producing an image thereon; a transfer portion for transferring the image formed with the powder mixture and the powder mixture forming the image produced on the intermediate transfer medium to the recording medium; and a cleaning portion for removing the powder mixture remaining on the intermediate transfer medium after transferring the image formed with the powder mixture and the powder mixture forming the image produced on the intermediate transfer medium to the recording medium.

According to another preferred embodiment of the present invention, it is possible to provide an improved recording method and apparatus which is compact, light and energy-saving. Furthermore, an improved transfer efficiency, a high-resolution image on the recording medium and the image formation on both surfaces can be achieved without image blur, color mixing and liquid penetration problems.

BRIEF DESCRIPTION OF THE DRAWINGS

Other objects, features and advantages of the present invention will become more apparent from the following detailed description of preferred embodiments when read in conjunction with the accompanying drawings, in which.

DETAILED DESCRIPTION OF THE INVENTION

Figure 1:
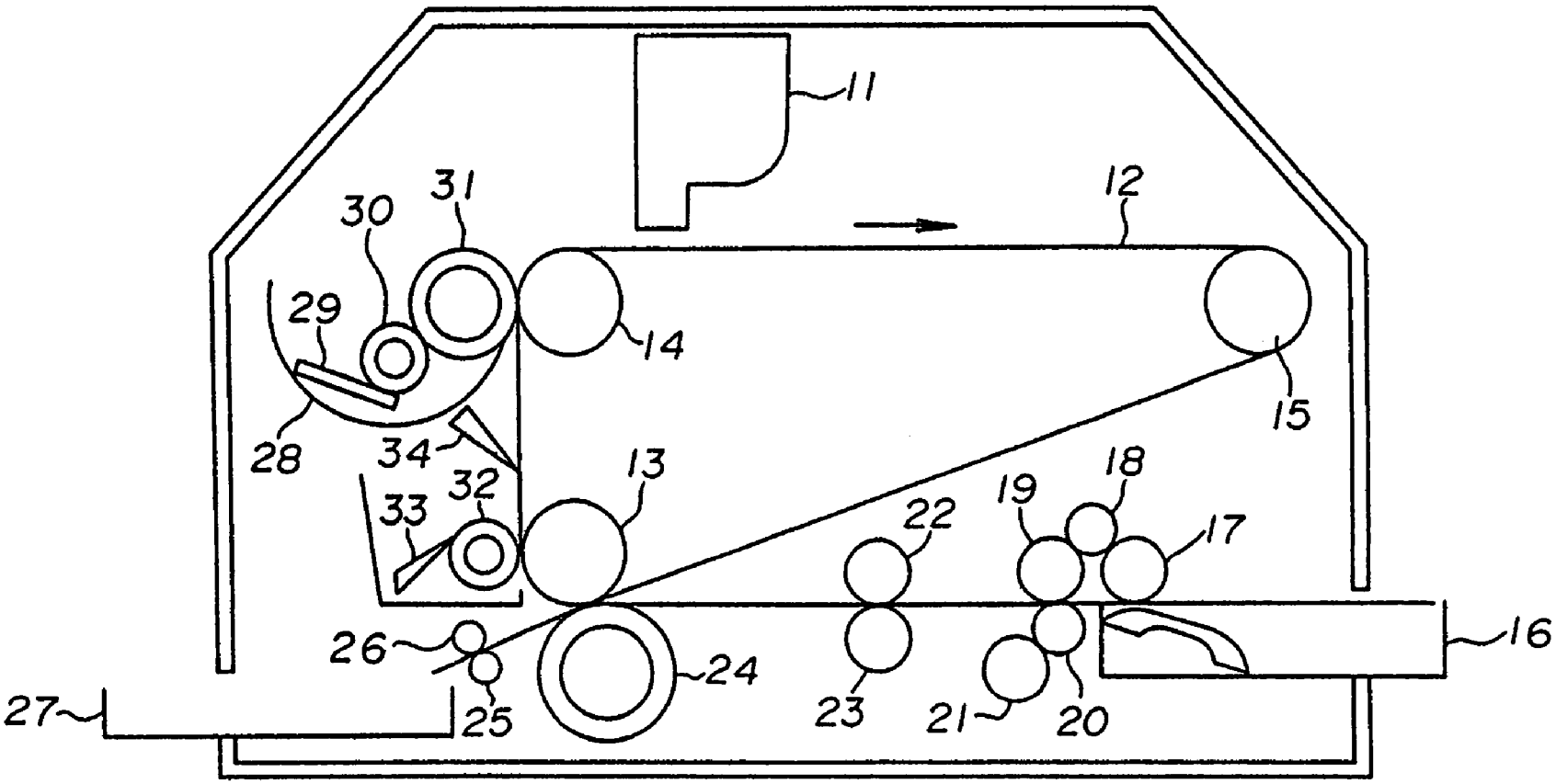
FIG. 1 shows a schematic view of an apparatus illustrating a preferred embodiment of a recording method and apparatus according to the present invention.

Referring to FIG. 1, a recording apparatus according to a preferred embodiment of the present invention is shown. The recording apparatus preferably contains a recording head 11 for projecting an ink liquid and an intermediate transfer medium belt 12 (which will be hereinafter abbreviated as ITM belt). The ink liquid is emitted from the recording head to a layer of an intermediate transfer element (which will be hereinafter abbreviated as ITE) provided on the uppermost surface of the belt 12 in response to an image signal. The belt 12 is driven and transported endlessly between three rollers 13, 14, 15 by a motor (not shown) at a substantially uniform speed, as depicted by the arrow. An image produced by the ink liquid and the ITE forming the image provided on the belt 12 can be transferred to a recording medium from a tray 16, which is transported by feed rollers 17, 18, 19, 20, 21 and register rollers 22, 23 with an action of a transferring compression roller 24. The recording medium which has the transferred image from the belt 12 is ejected from the apparatus to an output tray 27 by output rollers 25, 26.

The ITEs contained in an intermediate transfer element container 28 are coated on the uppermost surface of the ITM 12 via a coating roller 31 and a coating blade 29 which is used to control a quantity of coating in combination with an auxiliary roller 30.

Figure 2A:
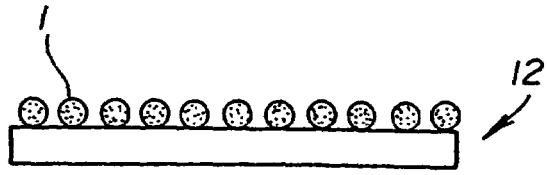
FIGS. 2A through 2E show illustrative views showing various stages of intermediate transfer elements on an intermediate transfer medium used in preferred embodiments of the present invention in FIG. 1.

FIG. 2A illustrates a schematic view showing an initial state of the ITE 1 coated on the ITM belt 12. The ITM 12 has an adhesive surface for the ITE, explained later with respect to materials for the ITM.

Figure 2B:
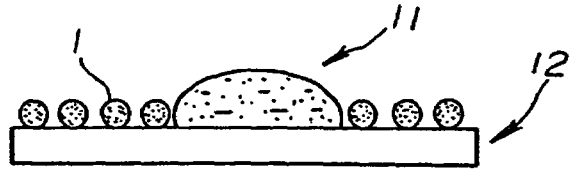

FIG. 2B shows an illustrative view showing a state of the ITE 1 with the ink liquid printed on the ITM 12 via the recording head. The ITE absorbs water contained in the liquid so as to cause swelling, so that a viscosity of the liquid on the ITM 12 increases, thereby producing the liquid image 11 having a sticky property. The ITE will be explained in detail later.

Figure 2C:
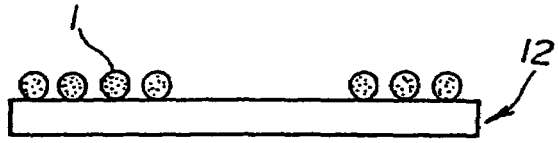

FIG. 2C shows a state of the ITE 1 after transfer of the image to the recording medium. When the recording medium is fed on the ITM 12, the only liquid-d image li can be transferred to the final recording medium because the only liquid image 11 has the increased viscosity. The ITEs in a background portion, which are not supplied with the liquid, are left on the ITM.

Figure 2D:
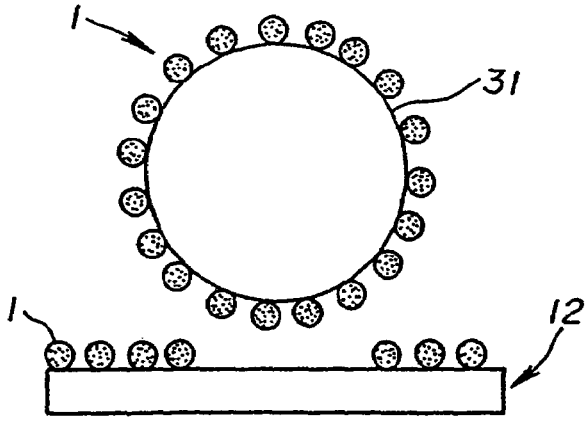
Figure 2E:
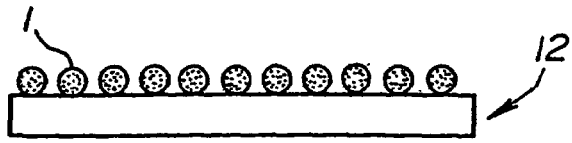

FIG. 2D illustrates a schematic view showing a state of the ITE 1 re-coated after transfer by the coating roller 31. This ITE can be re-coated by the roller 31 to provided on only an exposed surface of the ITM 12 so as to lead to an initial state shown in FIG. 2(E), because this exposed surface is an adhesive surface and the other surface is not adhesive due to coverage by the ITEs. This re-coating results from the fact: that adhesion strength between the surface of the ITM and a new ITE is larger than that between the ITE remaining on the ITM and the new one.

Returning to FIG. 2C, alternatively, the ITE 1 remaining on the surface of the ITM belt 12 can be also removed by a cleaning roller 32 and cleaning blades 33, 34 as needed, so that the new ITE can be re-coated on the ITM.

Figure 3:
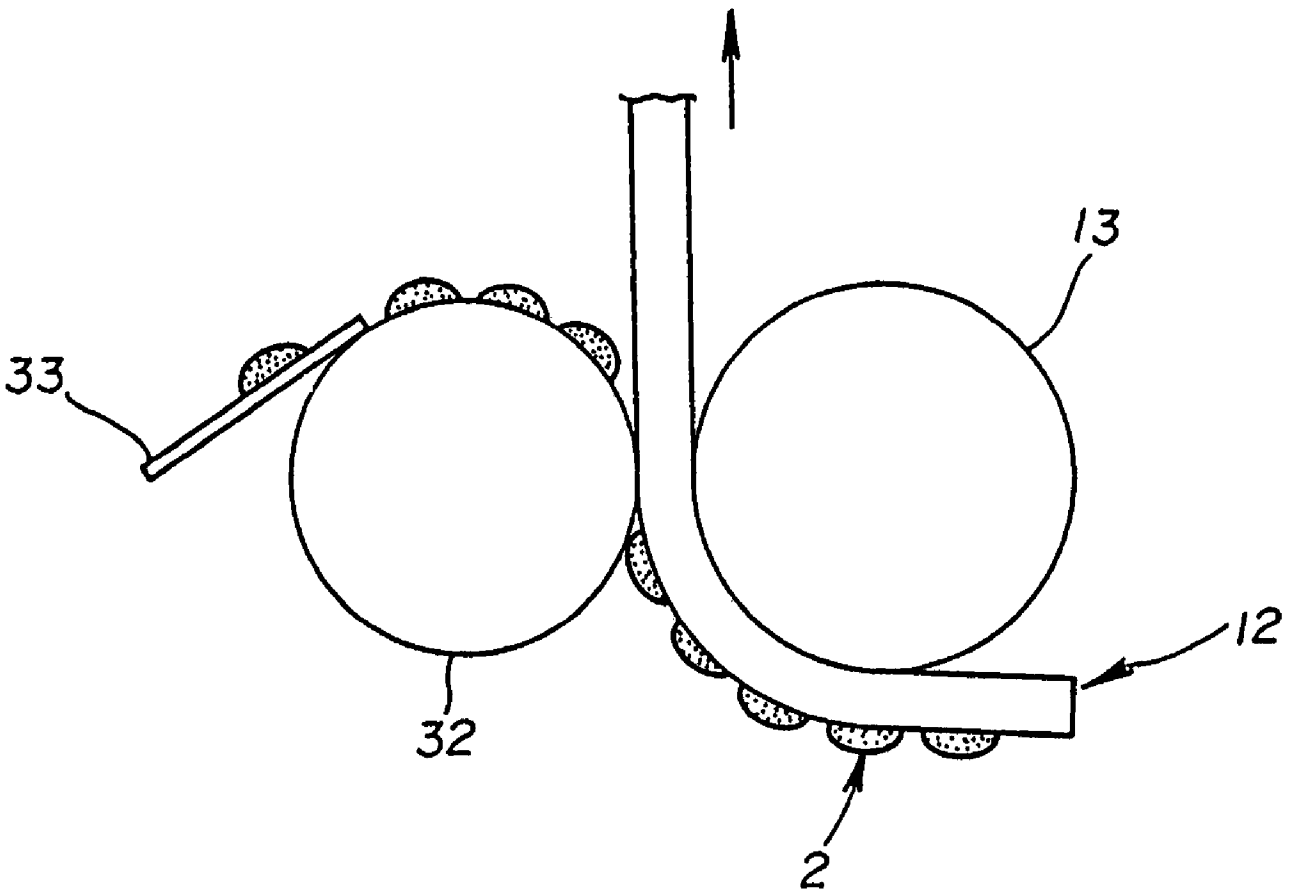
FIG. 3 shows an intermediate transfer elements-removing structure illustrating another preferred embodiment of the recording method and apparatus according to the present invention.

When the ITEs in an unused state are allowed to stand for a long time, the ITEs on the ITM can absorb a moisture in air to cause the ITEs to become viscous. Since these ITEs having water absorbed are not suitable to achieve the goals and objects and advantages of the present invention, it is desirable that these ITEs are removed from the ITM before a subsequent operation. To this end, there is provided a cleaning member 32 (shown in FIG. 3) having a surface which has poor releasing ability for the ITE 2 having the increased viscosity by the liquid or absorption of the moisture in air, in comparison with the surface of the ITM belt 12. As shown in FIG. 3, after depositing these ITEs having absorbed water on the cleaning roller 32, they can be removed from the cleaning roller completely via the cleaning blade 33. For a subsequent operation, new ITEs can be re-coated on the ITM 12.

If a surface of the compression roller 24 (shown in FIG. 1) has a poor releasing ability in comparison with that of the ITM 12, this roller 24 performs the same function as the cleaning roller 32 without feeding the recording medium.

In the prior art, to prevent clogging of the recording head, it is necessary that a recovery operation of the recording head is carried out periodically. In this case, ink liquids used in this operation are disposed by absorption of ink liquids into a felt or other suitable material. The removed ITEs 2 which have generally still sufficient water-absorbing ability can be stored in a collection container (not shown) of the apparatus and the used ink liquids produced in this recovery operation can also be delivered to the collection container. In this way, the used ink liquids are absorbed by the removed ITEs so that they can be disposed together.

According to preferred embodiments of the present invention, the ITE 1 is dissolvable and swellable by the liquid and enables a viscosity of the liquid to be increased, and forms a layer of a powder removably provided on the ITM. It is preferred that the ITE is a water-absorbing or a water-soluble polymeric powder having a particle diameter of about 0.05 μm to about 50 μm, preferably about 0.1 μm to about 10 μm in a case where the ink liquid is an aqueous base. Conversely, when the ink liquid is an oily base, the ITE is preferably an oil-absorbing or a oil-soluble polymeric powder. Since this powder is present as a fine powder on the ITM and has a weak aggregation force between the powders, an irregularity between an imaged part produced by printing the liquid and a background part on the ITM has only an order of a few microns when the liquid is printed on the layer provided on the ITM, thereby producing an excellent image. When the particle diameter of the powder is less than about 0.05 μm, the powder tends to aggregate to grow a large mass, because the aggregation force between the powders become strong, thereby causing an inability to obtain an image with good resolution. When the particle diameter is more than about 50 μm, the aggregation strength between the powders becomes so weak that the powder tends to become less viscous and that the transferred image can be degraded.

In the case of a water-based liquid, examples of such powders constituting the ITEs used in preferred embodiments of the present-invention include but are not limited to acrylic acid resin, acrylic acid/methacrylic acid copolymer resin, methacrylic acid resin, maleic acid resin, acrylic acid/maleic acid copolymer resin, poly(alkyl oxide) such as poly(ethylene oxide), poly(vinyl pyrrolidone), poly(vinyl alcohol), poly(vinyl butyral), poly(acrylic acid), an salt of poly(acrylic acid), isobutylene/maleic acid copolymer, polyacrylamide, polypropylene glycol, glue, gelatin, casein, albumin, gum arabic, alginic acid, methyl cellulose, carboxymethyl cellulose, hydroxyethyl cellulose, poly(vinyl ether), polyethylene glycol, glucose, xylose, sucrose, maltose, arabinose, a-cyclodextrin, starch, crosslinking polymers thereof or other suitable materials. In the case of oil-based liquid, examples of such ITEs used in preferred embodiments of the present invention include but are not limited to petroleum-based polymer, rosin-modified phenol polymer, alkyd resin, crosslinking polymers thereof or other suitable materials.

As another preferred embodiment of the present invention, in order to obtain an improved image with good light resistance, the ITE preferably includes a powder which has water-absorbing ability and an ultraviolet stabilizer. The ultraviolet stabilizer can be transferred to the recording medium together with this powder which has water-absorbing ability. An imaged produced in such a way exhibits an ultraviolet absorbing affect. Thus, the image containing the ultraviolet stabilizer has good storage stability even under the environment of light irradiation because of no or less bleaching of dye or pigment components contained in the images caused by light absorption. Since the ultraviolet stabilizer is not contained in an ink liquid tank in advance, the recording head clogging due to a aggregation reaction of this stabilizer with components of the ink can be eliminated, thus leading to good ejection stability of the apparatus.

When the ultraviolet stabilizer has a chemical structure based on benzophenone compounds, benzotriazole compounds and triazine compounds, it is effective to absorb an ultraviolet ray, thereby achieving light resistance and improved storage stability of the image. Use of a water-soluble stabilizer results in a very high quality image. In case of an organic ultraviolet stabilizer, there is a wider selection of species of the ultraviolet stabilizers because a variety of the ultraviolet stabilizers can be prepared. The organic ultraviolet stabilizers based on, for example benzophanone, benzotriazole and salicylic acid compounds are as follows. Example of these stabilizers include but are not limited to 2,4-hydroxybenzophonone, 2-hydroxy-4-methoxy-benzophenone, 2-hydroxy-4-octoxybenzophenone, 2-(2'-hydroxy-5'-methylphenyl)benzotriazole, 2-(2'-hydroxy-5'-tert-butylphenyl)benzotrlazole, phenyl salicylate, p-tert-butylphenyl salicylate, and p-octylphenyl salicylate.

Typical ultraviolet stabilizers preferably used in preferred embodiments of the present invention are salts of sulfonic and carboxylic acids of the water-soluble dye. Examples of such stabilizers include C. I. Acid Red 27, C. I. Acid Blue 9, C. I. Acid Yellow 23, C. I. Direct Blue 199, C. I. Direct Yellow 86, Food Black 2 or the like.

When an inorganic ultraviolet stabilizer, for example titanium oxide and cerium oxide or the like is used as the ultraviolet stabilizer, an image having excellent sharpness can be obtained with highly efficient absorption of the ultraviolet rays, thus leading to formation of the image having light resistance and excellent storage stability. In addition, since the inorganic ultraviolet stabilizer exhibits excellent heat resistance, this effect in the image is maintained for a long period of time. Furthermore, because the inorganic ultraviolet stabilizer is not contained in the ink liquid tank in advance, the recording head clogging due to aggregation reactions of the stabilizers with the ink liquid are eliminated, thus leading to excellent reliability and ejection stability of the apparatus.

As mentioned above, inclusion of the ultraviolet stabilizer in the ITE results in enhancement of light resistance and storage stability of the image transferred from the ITM. When a content of the ultraviolet stabilizer is less than about 0.1% by weight relative to the powder which has an ink liquid-absorbing property, the image having excellent light resistance can not be obtained because a concentration of the ultraviolet stabilizer relative to colorants contained in the ink liquid is very low. On the other hand, when the content of the ultraviolet stabilizer is more than about 10% by weight relative to the powder, the image with excellent light resistance can be produced, but a quality of the image is degraded, ideally, inclusion of the ultraviolet stabilizer having a content of from about 0.1% to about 1% by weight relative to the powder results in an excellent image having both high quality and light resistance.

When the ink liquid is based on an anionic colorant, a cationic compound which reacts with the anionic colorant is preferably used together with the powder. An oleophilic aliphatic amine as the cationic compound reacts with a carboxylic group of the powder which has ink liquid-absorbing property to form a salt, thereby exhibiting moisture resistance, and this amine causes the colorant to be insolubilized in the image on the recording medium. Water resistance of the image produced on the basis of transfer-type recording mechanism is improved by using the oleophilic amine. Examples of such powders having a carboxylic group include acrylic acid/methacrylic acid copolymer resin, methacrylic acid resin, malelc acid resin, acrylic acid/maleic acid copolymer resin, crosslinking polymers thereof and other suitable materials as shown below.

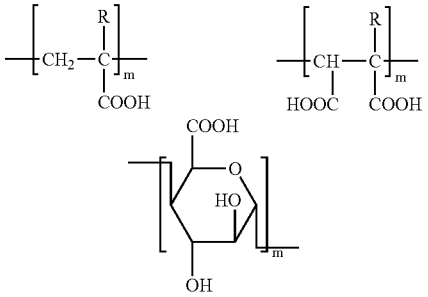

wherein R represents hydrogen or an alkyl group having 1 to 3 carbon atoms. Another examples of such powders include the super absorbent polymeric powders as mentioned above. Examples of aliphatic amines preferably used in preferred embodiments of the present invention include but are not limited to laurylamine, stearylamine, dodecylamine, rosinamine, diamylamine, triallylamine, tributylamine, polyallylamine or other suitable materials.

Although the preferable particle diameter of the powder has been explained above, there is a good relationship between the ITE and the ink liquid with respect to their diameters. When particle diameters of the powder and the ultraviolet stabilizer are less than a half of a diameter of the ink liquid, the ITE achieves excellent contact with the ink liquid on the ITM because of a large surface area of the ITE. This enables the ITE to react with the liquid rapidly, so that a viscosity of the liquid is increased and the image having excellent resolution can be obtained after transfer of the liquid image thus produced on the ITM to the recording medium. If the particle diameter of the ITE is too large, the ITE exhibits poor contact with the ink liquid on the ITM so that the viscosity of the liquid is not increased instantaneously. This induces inaccuracy of the image position on the ITM. Conversely, if the particle diameter of the ITE is too small, it is difficult to control the quantity of coating so that quality of the transferred image is deteriorated.

As another preferred embodiment of the present invention, in order to improve a transfer efficiency and obtain a high-resolution image on a recording medium after transfer and the images on opposite surfaces of the recording medium with elimination of ink liquid blur and color mixing and liquid penetration problems, the ITE is formed of a powder mixture preferably including a plurality of powders, each of which has different chemical and physical properties.

When the powders are supplied with the ink liquids from the recording head, for example, an ink jet recording head so as to produce the image on the ITM, a water component of the ink liquids is absorbed by the powders, and one portion of these powders can swell and the other portion of these powders can dissolve in the ink liquid. This induces the increase in viscosity of the ink liquid so as to prevent spreading of the liquid which causes undesired intermixing of adjacent liquids. Furthermore, pigment and dye components contained in the ink liquid can adsorb and bond to the powders physically and chemically, or the powders undergo a weak crosslinking reaction intermolecularly and intramolecularly, thus leading to condensation of the pigment and dye components in the ink liquid and the increase in viscosity of the liquid.

When the image and the powder holding the image on the ITM are transferred to the recording medium, a high-resolution image can be produced because of adhesive force due to the above condensation and the increased viscosity, and an adhesive force difference between an imaged portion (this portion is applied with the liquid) and a background portion (this portion is not supplied with it) on the ITM. Even if the recording medium is a paper, ink liquid blurring does not take place because of condensation of the ink liquid. Further, because the pigment and dye components are attached to the powder, these components of the ink liquid cannot penetrate into the paper. This assures that the image transferred to the paper has excellent high-resolution quality in absence of ink liquid blurring and penetration problems.

In addition, image quality is dependent on powder properties, for example solubility and swellability for the liquid, increasability of the viscosity of the liquid including the powder, separability of the liquid including the powder from the ITM, the particle diameter of the powder or the like. We have discovered that an even more excellent image quality can be obtained using the powder mixture including the plurality of powders, each of which has different physical and chemical properties.

A crosslinking density of the powder relates to absorbing ability and viscosity of it. In general, the water-absorbing ability can be classified into three groups according to the crosslinking density. The water-absorbing powder with a low crosslinking density has low absorbing ability but this powder becomes very viscous upon absorbing water. The powder with an appropriate crosslinking density exhibits high absorbing ability. When this powder absorbs water, it can swell to grow a gel. The powder with a high crosslinking density has low absorbing ability, a viscosity of this powder becomes low when absorbing water. Taking the above into consideration, if the powder mixture including the powders having the low crosslinking density and the appropriate crosslinking density is used for the ITE, condensation of the ink can be realized by the powder with the appropriate crosslinking density and enhancement of the transfer efficiency to the recording medium can be accomplished by the powder with the low crosslinking density. Therefore, the excellent image quality can be obtained on the recording medium. By way of example, Japanese Patent Publication No. 32-4141 describes a method for polymerizing a monomer having a carboxyl acid, in which an acrylic acid monomer is polymerized in an aqueous solution. In the presence of about 0.5% by weight of acrylic sorbitol as a crosslinker, polymerization of acrylic acid monomer gives a very viscous polymer. As another example showing a polymer having the appropriate crosslinking density, in the presence of about 1.0% by weight of acrylic sorbitol as the crosslinker, polymerization of acrylic acid monomer gives a polymer with a high swellability, which can absorb 600 times water relative to itself weight.

In preferred embodiments of the present invention, a crosslinking agent is present in a concentration of from about 0.0005 mol % to about 2.0 mol % in the polymerization as an indication of the crosslinking density. Preferably, it is present in the concentration of from about 0.001% to about 1.0 mol %. When the concentration of the crosslinking agent is less than about 0.0005 mol %, the image quality is degraded due to absence of crosslinking affect of the powder. On the other hand, when the concentration of it is more than about 2.0 mol % to produce a polymer having the high crosslinking density, the same result is obtained on the grounds mentioned above.

As a mixture ratio of powders for ITE, the powder having the appropriate crosslinking density is present in an amount of from about 1% to about 20%, and preferably 2% to 10% by weight. As the mixture ratio, when the amount of the powder having the appropriate crosslinking density is less than about 1% by weight, the image quality is degraded due to absence of the crosslinking effect of the powder. When the amount of crosslinking density is more than about 20% by weight, the image quality is deteriorated because of low viscosity of the powder supplied by liquid.

As another approach to improve the transfer efficiency and obtain the high-resolution image on the recording medium, the ITE may be preferably formed of two or more high water-absorbing powders, each of which has a different particle diameter. Generally, fluidity of the powder can be inherently controlled by its particle size and interaction between the powders and association structure of powder. In a case where an only fine particle powder is used for the ITEs, the powders are apt to aggregate by interaction between the powders so as to exhibit low fluidity. On the other hand, in a case of a only coarse particle powder, interaction between the powders is so weak and a void ratio is so large that the fluidity of the powder is high. Therefore, when the powder mixture including two or more powders, each of which has a different particle diameter, is used for the ITE, fluidity of the powder mixture is greatly improved, thereby applying it on the surface of the ITM uniformly. An even higher resolution image can be produced on the recording medium when the ink liquid is printed on the ITM of which surface has above powder mixture applied uniformly.

Furthermore, with respect to the viscosity in comparison to a case of the only coarse powder for use in the ITEs with a case of the only fine powder for use in the ITEs, when the ink liquids are printed on the various powders, each of which having a different particle size, with the same volume of the liquid, the fine powder can be dissolved immediately so as to become viscous and the coarse powder can only swell so that its viscosity does not increase appreciably. Therefore, by mixing the powders having the different particle sizes, the holding ability of the powder mixture for the ink liquid and the increase in viscosity caused by the liquid can be ameliorated, thus leading to an excellent transfer efficiency.

As the diameter difference, the coarse powder preferably has a particle diameter of from about 1.5 to about 100 times, and more preferably from about 2 to about 50 times that of the fine powder. When the difference of the particle diameter is less than about 1.5 times, there is no size difference between the fine and coarse powders, so that the excellent image can not be obtained. When the difference is more than about 100 times, a smoothness of the transferred image does not keep constant, so that the excellent image can not be produced. As a mixture ratio of powders, the coarse powder is present in an amount of from about 1 to about 20, and preferably about 2 to about 10% by weight. When the amount of the coarse powder is less than about 1% by weight, the image quality can not be improved due to absence of effect of particle diameter difference. When the amount of the coarse powder is more than about 20% by weight, the image quality is deteriorated because of low viscosity of the powder supplied by the liquid.

As another approach to improve transfer and fixing efficiencies, there can be used a mixture powder including a re-wet adhesive agent which becomes sticky on absorbing water and the super absorbent polymer. Condensation of the ink liquid supplied by recording head (that is, the ink liquid image on the ITM) is carried out by the super absorbent polymer. Also, adhesion strength during transfer and adhesion step of the condensed ink liquid and the super absorbent polymer holding the image on the ITM to the recording medium can be reinforced by the re-wet adhesive agent. Therefore, the transfer and fixing efficiencies with an action of the super absorbent polymer and the re-wet adhesive agent become high, thereby producing an excellent high-resolution image.

As a mixture ratio of the re-wet adhesive agent, it is preferably present in an amount of from about 1% to about 20% by weight, and preferably about 2% to about 10% by weight. When the amount of it is less than 1% by weight, a large part of water contained in the ink liquid is absorbed by the super absorbent polymer so that the rewet adhesive agent fails to function and that the transfer and fixing efficiencies can not be improved. When the amount of the re-wet adhesive agent is more than about 20% by weight, the re-wet adhesive agent is mainly dissolved in the ink liquid so that a drying efficiency of the transferred image is deteriorated.

The re-wet adhesive agent is an adhesive agent which is dried powder after coating and drying an aqueous solution dissolving this agent, but it is wetted by water or vapor prior to transfer so as to be re-dissolved in water, thus providing adhesive strength. Examples of such re-wet adhesive agents include but are not limited to casein, starch, poly(vinyl alcohol), poly(vinyl ether), a salt of poly(acrylic acid) or other suitable materials.

Materials for the ITM used in preferred embodiments of the present invention are preferably rubbers suitable for transfer of the ITE which holds the ink liquid image produced by printing the liquid in response to an image signal, from the ITM to the recording medium. Examples of such materials include but are not to limited to silicone rubber, fluorosilicone rubber, phanyl silicone rubber, fluorine-containing rubber, chloroprene rubber, nitrile rubber, ethylene-propylene rubber, natural rubber, styrene rubber, isoprene rubber, butadiene rubber, ethylene/propylene/butadiene polymer, and nitrile/butadiene polymer. More preference is given to silicone rubber, fluorosilicone rubber, phenylsilicone rubber, fluorine-containing rubber and chloroprene rubber. These rubbers enable the ink liquid image on the ITM to be transferred to the final recording medium substantially and completely.

Representative examples of the recording medium used in preferred embodiments of the present invention are as follows, but are not limited to the following. Examples of such media include a recording medium with an image forming surface including at least a cellulose fiber as a main component, a recording medium with an image forming surface including at least a partially crosslinked water-soluble polymer, for example, polyethylene glycol, a acrylic acid-based polymer as the main component, a recording medium used in the inkjet recording method and other suitable materials. Specifically, examples of such media include a general plain paper or a recording paper for copying, which are based on the cellulose fiber and are available commercially, a plastic film for an overhead projector, a paper stacked by paper layer with an imaging forming surface including at least the cellulose fiber as the main component, a plastic film with a layer including at least a partially crosslinked water-swellable polymer, for example, an acrylic acid-based polymer and a methacrylic acid-based polymer as the main component, a glass, a wooden plate, a non-woven fabric, a cloth, a metal plate or the like.

From a multi-color reproduction standpoint in a case of a color recording, it is preferred that a color tone of the final image on the recording medium is the same as the color of the ink liquid. Thus, a color of the powder mixture is preferably colorless or white. Further, from a monocolor reproduction standpoint in spite of the multi-color recording, it is not necessary that the ink liquid containing a color agent is printed on the ITM. It is possible to mix the color agent which is available commercially with the powder when a transparent liquid, for example, water is printed on the ITM. Even if the colored liquid is used, it is also possible to mix the color agent having a complementary color relation to the color of the liquid with the powder so as to produce a black image, so that there is a wider selection of the color image. It should be noted that the complementary relation in preferred embodiments of the present invention means a color of substance (that is, complementary color relation in subtractive color process). For example, this is color relation between red and green, orange and blue, yellowish green and reddish purple and the like.

In order to coat the powder mixture according to preferred embodiments of the present invention on the ITM, there can be used many coating methods, although a coating part is not shown in FIG. 1. One coating method is based on an electrostatic attractive force to achieve the coating of the powder mixture which is charged positively or negatively, in a case where the surface of the ITM is charged negatively or positively. Other coating methods are follows: a method for rubbing the powder mixture physically so as to apply it on the surface of the ITM by means of a roller, a blade and a plate of which surface is flat, for example, a plastic, a glass, a metal, ceramics, a brush or the like; a method for rubbing the powder mixture while rotating the surface of the ITM so as to apply it on the surface of the ITM by using a plate-like porous elastic body, for example a sponge, a paper, a cloth, a rubber or the like; a method for spraying the powder mixture on the ITM surface by means of a spray.

In accordance with preferred embodiments of the present invention, by using a transfer part for transferring the ink liquid image formed with the powder mixture and the powder mixture forming the image to the recording medium, the ink liquid image formed with the powder mixture and the powder mixture forming the image are contacted with the recording medium with actions of compression by a guide roller 13 (shown in FIG. 1) or heat and compression, thereby lead to transfer to the recording medium. Examples of representative methods and members for use in a transfer step include but are not limited to a method for compressing or heating and compressing the ITM with the recording medium by means of a roller, a blade, a plate having a flat surface, for example a plastic, a glass, a metal, ceramics, and a plate-like or roller-like porous elastic body, for example a sponge, a paper, a felt, a cloth, a rubber or the like.

According to need, it is possible to provide a heating portion within the roller in the case where the roller is used as the heating and compressing member. In the event of the plate-like member for use in the heating and compressing step, there is provided the heating portion, for resistance heating and heating coil within this member. Use of the heating portion makes it possible to dehydrate the ink liquid on the ITM rapidly and compulsorily, so that more high-speed recording can be realized.

As described the above, the recording method according to preferred embodiments of the invention provides the image with high-resolution on the recording medium while preventing image blurring, color mixing and liquid penetration problems. Therefore, another image can be produced on the other surface which is not supplied with the image, thereby leading to formation of images on opposite surfaces.

In order to improve images with light resistance, the following experiments were carried out by using the ultraviolet stabilizer. Furthermore, there can be also used an oleophilic amine for improvement of water resistance of the images produced on the basis of transfer-type recording mechanism.

EXAMPLE 1

The experimental conditions were as follows:

Liquid Recording Device:

An ink-jet printer based on an intermediate transfer mechanism, having a recording head for projecting a liquid in response to an image signal, was used in this experiment.

Recording Medium:

Wood-free paper (Ricoh PPC paper).

Intermediate Transfer Element:

There was used a mixture of poly(acrylic acid)(Hitachi Chemical, this material will be hereinafter abbreviated to PAA) which has water-absorbing ability as a thickener member and SUMISOPU 90(Sumitomo Chemical) as the ultraviolet stabilizer.

Method for Forming an Image to the Recording Medium:

As is shown in FIG. 1, the above ITE including the above mixture was coated on the ITM which is a water-repellent member. By using the liquid recording device, images were produced on the wood-free paper, comparing with images printed by means of a conventional method which does not use an intermediate transfer-type recording mechanism.

Evaluation of Light Resistance:

An optical density (which will be hereinafter abbreviated to OD) of the transferred images was measured to evaluate light resistance. After irradiation for 50 hours by xenon fade meter under the conditions of 35° C., 70% RH (that is, relative humidity), the OD value of the images treated above was re-measured.

Results:

In comparison with images produced by the ink jet printing on the conventional method, good images with water resistance were formed while achieving prevention of ink liquid blurring and liquid penetration problems. After irradiation, a residual OD value of the images transferred from the ITE containing the ultraviolet stabilizer was more than 85% which is higher than that of images before irradiation. This result indicates that the images produced in this experiment have good light resistance.

EXAMPLE 2

Liquid Recording Device:

The same device as EXAMPLE 1 was used.

Recording Medium:

Wood-free paper (Ricoh PPC paper).

Intermediate Transfer Element:

A mixture of PAA and 1 wt % of the ultraviolet stabilizer, DIC-TBS (Dainippon Ink Chemicals), relative to PAA, was used.

Method for Forming an Image to the Recording Medium:

As is shown in FIG. 1, the above ITE including the above mixture was coated on the ITM which is a silicone rubber. By using the same liquid recording device as EXAMPLE 1, images were produced on the wood-free paper.

Evaluation of Light Resistance:

Evaluation was carried out in the same way as EXAMPLE 1.

Results:

In comparison with images produced by the ink jet printing based on the conventional method, good images having water resistance were formed while eliminating ink liquid blurring and liquid penetration problems. After irradiation as explained in EXAMPLE 1, a residual OD value of the images transferred from the ITE containing the ultraviolet stabilizer was more than about 85% which is higher than that of images before irradiation, so that light resistance of the images produced in this experiment was greatly improved.

EXAMPLE 3

Liquid Recording Device:

The same device as EXAMPLE 1 was used.

Recording Medium:

Wood-free paper (Ricoh PPC paper).

Intermediate Transfer Element:

A mixture of PAA and 1 wt % of the ultraviolet stabilizer, cerium oxide (Nidoraru (Taki Chemicals)), relative to PAA, was used.

Method for Forming an Image to the Recording Medium:

As is shown in FIG. 1, the above ITE including the above mixture was coated on the ITM which is a silicone rubber. By using the same liquid recording device as EXAMPLE 1, images were produced on the wood-free paper.

Evaluation of Light Resistance:

Evaluation was carried out in the same way as EXAMPLE 1.

Results:

In comparison with images produced by the ink jet printing based on the conventional method, good images with water resistance were formed while eliminating ink liquid blur and liquid penetration problems. After irradiation, a residual OD value of the printed images transferred from the ITE containing the ultraviolet stabilizer is more than about 85% which is higher than that of images before irradiation, thereby producing the images with good light resistance.

COMPARATIVE EXAMPLE 1

Liquid Recording Device:
The same device as EXAMPLE 1 was used.

Recording Medium:
Wood-free paper (Ricoh PPC paper).

Intermediate Transfer Element:
Only PAA with no ultraviolet stabilizer was used.

Method for Forming an Image to the Recording Medium:
As is shown in FIG. 1, the above ITE was coated on the ITM which is a silicone rubber. By using the same liquid recording device as EXAMPLE 1, images were produced on the wood-free paper. As comparative images, images were formed on the same paper using the conventional method.

Evaluation of Light Resistance:
Evaluation was performed in the same way as EXAMPLE 1.

Results:
Although the images were formed on the wood-free paper with absence of liquid blur under low humidity conditions in comparison with the images produced by the conventional method, a residual OD value of printed images after irradiation was 70% which is lower than that of the printed images before irradiation, thereby leading to bad storage stability.

EXAMPLE 4

Liquid Recording Device:
The same device as EXAMPLE 1 was used.

Recording Medium:
Wood-free paper (Ricoh PPC paper).

Intermediate Transfer Element:
A mixture of PAA, oleophilic stearylamine (which will be hereinafter abbreviated to SA) for neutralization of PAA and the ultraviolet stabilizer, 0, 0.1, 1, 10, and 20 wt % of phenyl salicylate relative to PAA, was used.

Method for Forming an Image to the Recording Medium:
As is shown in FIG. 1, the above ITE including the above mixture was coated on the ITM which is a silicone rubber. By using the same liquid recording device as EXAMPLE 1, images were produced on the wood-free paper.

Evaluation:
(1) Evaluation of Light Resistance
The OD values of each of the printed images were measured before irradiation. After irradiation for 50 hours under the conditions of 35° C. and 70% RH by xenon fade meter, the OD values of each image were re-measured to estimate light resistance. Each was qualitatively rated as follows:

⓪ residual OD value after irradiation was more than 85%.
O The residual OD value after irradiation was more than 70%.
X The residual OD value after irradiation was less than 70%.

(2) Evaluation of Images
The sharpness of the images and color mixing of the liquid were estimated by observation. With respect to the sharpness and an irregular color, evaluation standards are as follows;

⓪ good
O relative good
X poor

Results:
A good storage stability was observed in the images having the ultraviolet stabilizer of from about 0.1% to about 10% by weight relative to PAA. In comparison with the images printed using the conventional method, liquid blurring and color mixing was improved. When using the ultraviolet stabilizer having more than about 10% by weight, light resistance of the images produced in the experiment was improved because of inclusion of the ultraviolet stabilizer in the images. However, the sharpness of the liquid images on the ITM was deteriorated, thereby producing the irregular color in the transferred images on the recording medium (Reference to Table 1).

TABLE 1

Results of evaluation.

| Weigh Ratio PAA:ultraviolet stabilizer | Sharpness | Irregular Color | Light Resistance |
|---|---|---|---|
| 100:0 | ⓪ | ⓪ | X |
| 100:0.1 | ⓪ | ⓪ | O |
| 100:1 | ⓪ | ⓪ | ⓪ |
| 100:10 | ⓪ | O | ⓪ |
| 100:20 | O | X | ⓪ |

EXAMPLE 5

Liquid Recording Device:
The same device as EXAMPLE 1 was used.

Recording Medium:
Wood-free paper (Ricoh PPC paper).

Intermediate Transfer Element:
A mixture of PAA, oleophilic SA for neutralization of PM and 0, 1, 6 wt % of the ultraviolet stabilizer relative to 10 by weight part of SA, was used. As a comparative powder, sodium of poly(acrylic acid)(which will be hereinafter abbreviated to PAS) was used in place of PAA. The oleophilic SA was contained in the ITE with a content of 0 and 2% by weight relative to 10 by weight portion of PSA.

Method for Forming an Image to the Recording Medium:
As is shown in FIG. 1, the above ITE was coated on the ITM which is a silicone rubber. By using the same liquid recording device as EXAMPLE 1, images were produced on the wood-free paper.

Evaluation of Light Resistance:
Evaluation was made in the same way as EXAMPLE 1.

Results:
When a ratio of the salt comprising PM and SA was present in an amount of from 10 wt % to 50 wt %, a good storage stability of the ITEs was observed even under humid conditions, and there was no obstacles to form the images. It was possible to produce the images having water resistance while eliminating liquid blurring and liquid penetration problems, as compared to the images printed by means of the conventional method. When the above ratio was more than 60 wt %, humidity resistance of the ITE and light resistance of the produced images were improved, although the improvement of sharpness of the images was not improved appreciably. When using PAS as the ITE, the liquid images quality was deteriorated on the intermediate transfer medium. (See Table 2).

With respect to the evaluation items, evaluation standards are as follows;

◎: good
O: relative good
Δ: relative poor
X: poor

TABLE 2

| | Evaluation Results | | | |
|---|---|---|---|---|
| WeightRatio Powder:SA | Storage stability[1] | Sharpness | Light resistance | Water resistance |
| PAA10:0 | Δ | ◎ | ◎ | X |
| PAA10:1 | ○ | ◎ | ◎ | ○ |
| PAA10:6 | ◎ | Δ | ◎ | ◎ |
| PAA10:0 | X | X | ◎ | X |
| PAA10:2 | X | X | ◎ | X |

[1]This stability was estimated under humid environment.

EXAMPLE 6

Liquid Recording Device:

The same device as EXAMPLE 1 was used. The diameter of the liquid was 100 μm.

Recording Medium:

Wood-free paper (Ricoh PPC paper).

Intermediate Transfer Element:

There was used a mixture of PM having a particle, diameter of 5 μm and cerium oxide having a particle diameter of 5 μm as the ultraviolet stabilizer.

Method for Forming Image to the Recording Medium:

As is shown in FIG. 1, the above ITE was coated on the ITM which is a silicone rubber. By using the same liquid recording device as EXAMPLE 1, images were produced on the wood-free paper.

Evaluation of Light Resistance:

Evaluation was performed in the same way as EXAMPLE 1.

Results:

In this experiment, a residual OD value of the images after irradiation as explained in EXAMPLE 1 was more than 85% than that of the images before irradiation, so that light resistance was improved. The images were produced with no ink liquid blurring and liquid penetration problems in comparison with the conventional ink jet images. Furthermore, the images having excellent sharpness were obtained.

COMPARATIVE EXAMPLE 2

Liquid Recording Device:

The same device as EXAMPLE 1 was used. The diameter of the liquid was 100 μm.

Recording Medium:

Wood-free paper (Ricoh PPC paper).

Intermediate Transfer Element:

There was used a mixture of PAA having a particle diameter of 60 μm and 2,4-hydroxybenzophenone having a particle diameter of 60 μm as the ultraviolet stabilizer.

Method for Forming an Image to the Recording Medium:

As is shown in FIG. 1, the above ITE was coated on the ITM which is a silicone rubber. By using the same liquid recording device as EXAMPLE 1, images were produced on the wood-free paper.

Evaluation of Light Resistance:

Evaluation was made in the same way as EXAMPLE 1.

Results:

Although light resistance of the images produced in this experiment was ameliorated compared with the conventional ink jet images, the liquid image on the ITM was blurred, so that the poor image quality was obtained, as compared to the conventional ink jet images.

In order to improve a transfer efficiency and obtain a high-resolution image and the images on both surfaces, there was used a powder mixture including a plurality of powders, each of which has different chemical and physical properties.

EXAMPLE 7

A mixture of Carbopol ETD2020 (Nikko Chemicals, trade name) and Carbopol ETD2050 (Nikko Chemicals, trade name) was mixed sufficiently, having a weight ratio of 5:1, by means of a mixer which is commercially available. The powder mixture was then rubbed on a silicone rubber with a coating weight of about 0.2 mg/cm$^2$ so as to apply the powder mixture on the rubber, so that the intermediate transfer element for image formation was produced. Liquid images were formed on the silicone rubber by supplying the liquids based on aqueous inks onto the powder mixture via an ink jet recording apparatus which is commercially available. Immediately, the liquid images and the powder mixture forming the liquid images on the silicone rubber were transferred to a plain paper (i.e., PPC paper for copying) by compressing together. Table 3 shows the results of the image produced above (See below). As is shown in Table 3, the image with good resolution and an excellent transfer efficiency was obtained in this EXAMPLE 7.

COMPARATIVE EXAMPLE 3

The same procedure as EXAMPLE 7 except using only Carbopol ETD2050 was carried out in this experiment. The results of COMPARATIVE EXAMPLE 3 are shown in Table 3 with the results of EXAMPLE 7 (see below).

COMPARATIVE EXAMPLE 4

The same procedure as EXAMPLE 7 except using only Carbopol ETD2020 was performed in this experiment. The results of COMPARATIVE EXAMPLE 4 are shown in Table 3 with the results of EXAMPLE 7 (see below).

TABLE 3

| The Results of EXAMPLE 7, COMPARATIVE EXAMPLES 3 AND 4. | | |
|---|---|---|
| | Resolution | Transfer Efficiency |
| EXAMPLE 7 | ◎ | ◎ |
| COMPARATIVE EXAMPLE 3 | ○ | Δ |
| COMPARATIVE EXAMPLE 4 | ○ | X |

(Estimation standard)
◎: good,
○: relative good,
Δ: relative poor,
X: poor

EXAMPLE 8

A super absorbent polymer having a appropriate crosslinking density was synthesized with reference to the publication ("A super absorbent polymer" Kyouritu Press, 1997). After neutralizing 39.1 g of acrylic acid with 76.5 g of sodium hydroxide solution having 22.6 percent by weight, 0.13 g of potassium persulfate was added to this solution containing neutralized acrylic acid. The resulting solution was added to a hexane solution containing 1.9 g of sorbitan monolaurate so as to give a dispersed solution. Nitrogen was introduced into the dispersed, solution, a reverse-phase suspension polymerization was then carried out at temperature of from about 55° C. to 60° C. After polymerization, filtration of the polymerization solution and drying a resultant powder gave a water-soluble polymer. A water-absorbing ability of this polymer was 20 ml after one minute.

An amount of 41 g of this polymer was dispersed in a mixture containing 50 g of methanol which contains 32 mg of ethylene glycol diglycidyl ether and 9 g of water. Then, by maintaining this dispersed solution at temperature of 110°0 C., a super absorbent polymer was obtained through vaporization of the solution. This polymer was ground by means of a grinder which is commercially available. A water-absorbing ability of the pulverized polymer was 700 ml after one minute.

EXAMPLE 9

The same procedure as EXAMPLE 7 except using a mixture of the super absorbent polymer prepared in EXAMPLE 8 and Carbopol ETD2050 which has no crosslinking structure, with a weight ratio of 5:1, was carried out in this experiment. The results are shown in Table 4. As is evident from Table 4 with the results of COMPARATIVE EXAMPLES 3 and 5 (shown below), the image with good resolution and an excellent transfer efficiency was obtained in this EXAMPLE 9.

COMPARATIVE EXAMPLE 5

The same procedure as EXAMPLE 7 except using the only super absorbent polymer prepared in EXAMPLE 8 was carried out in this experiment. The results of COMPARATIVE EXAMPLE 5 are shown in Table 4 with the results of EXAMPLE 9 (see below).

TABLE 4

The Results of EXAMPLE 9, COMPARATIVE EXAMPLES 3 AND 5.

| | Resolution | Transfer Efficiency |
|---|---|---|
| EXAMPLE 9 | ◎ | ◎ |
| COMPARATIVE EXAMPLE 3 | ○ | Δ |
| COMPARATIVE EXAMPLE 5 | ○ | X |

(Estimation standard)
◎: good,
○: relative good,
Δ: relative poor,
X: poor

EXAMPLE 10

The same procedure as EXAMPLE 7 except using a mixture of Akuarrilu AS-58 (Nihon Shokubai, Trade name) which was ground to a coarse particle diameter of 20 μm by a ball mill grinder and Carbopol ETD2050 having a particle diameter of 0.5 μm with a weight ratio of 1:10, was carried out in this experiment. The results are shown in Table 5. As is shown in Table 5 with the results of COMPARATIVE EXAMPLES 3 and 6 (shown below), the image with good resolution and an excellent transfer and fixing efficiencies was obtained in this EXAMPLE 10.

COMPARATIVE EXAMPLE 6

The same procedure as EXAMPLE 10 except using only Akurarriku AS-58 (Nihon Shokubai, Trade name) which was ground to a coarse particle diameter of 20 μm was carried out in this experiment. The results of COMPARATIVE EXAMPLE 6 are shown in Table 5 with the results of EXAMPLE 10 and COMPARATIVE EXAMPLE 3 (see below).

TABLE 5

The Results of EXAMPLE 10, COMPARATIVE EXAMPLES 3 and 6.

| | Resolution | Transfer Efficiency | Fixing Efficiency |
|---|---|---|---|
| EXAMPLE 10 | ◎ | ◎ | ◎ |
| COMPARATIVE EXAMPLE 3 | ○ | Δ | ○ |
| COMPARATIVE EXAMPLE 6 | ○ | X | X |

(Estimation standard)
◎: good,
○: relative good,
Δ: relative poor,
X: poor

EXAMPLE 11

The same procedure as EXAMPLE 7 except using a mixture of the super absorbent polymer powder prepared in EXAMPLE 8 and poly(vinyl alcohol) as a rewetting adhesive agent with a weight ratio of 10:1, was carried out In this experiment. The results are shown in Table 6. As is shown in Table 6 with the results of COMPARATIVE EXAMPLE 5, the image with good resolution and an excellent transfer and fixing efficiencies was obtained in this EXAMPLE 11.

TABLE 6

The results of EXAMPLE 6 and COMPARATIVE EXAMPLE 5.

| | Resolution | Transfer Efficiency | Fixing Efficiency |
|---|---|---|---|
| EXAMPLE 11 | ◎ | ◎ | ◎ |
| COMPARATIVE EXAMPLE 5 | ○ | X | X |

(Estimation standard)
◎: good,
○: relative good,
Δ: relative poor,
X: poor

EXAMPLE 12

A mixture of Carbopol ETD2020 and Carbopol ETD2050 was mixed sufficiently, having a weight ratio of 5:1 by means of the mixer which is commercially available. The powder mixture was then rubbed on the silicone rubber with a coating weight of 0.095 mg/cm$^2$ so as to apply the powder mixture on the rubber, so that the intermediate transfer element for image formation was produced. Liquids images were formed on the silicone rubber by supplying the liquids based on aqueous inks onto the powder mixture by means of the ink jet recording apparatus which is commercially available. Immediately, the liquid images and the powder mixture forming the liquid images on the silicone rubber were transferred to the plain paper (i.e., PPC paper for copying) by compressing together. Optical densities of the images on both a surface having the images (this surface is herein referred to as front surface) and back surface were measured by a densiometer (GRETAG) to estimate a degree of the liquid penetration. As is shown in Table 7, the results show that there was no liquid penetration problem In the Images produced in this EXAMPLE 12 (See Table 7).

EXAMPLE 13

The same procedure as EXAMPLE 12 except using the only silicone rubber having a coating weight of 0.19 $Mg/CM^2$ of the powder mixture similar to EXAMPLE 12 was carried out in EXAMPLE 13. Like EXAMPLE 12, there was no observation of liquid penetration in the images produced in this experiment (See Table 7).

COMPARATIVE EXAMPLE 7

With no use of the powder mixture used in EXAMPLE 12, the aqueous ink liquid which is commercially available was printed on the same plain paper (PPC paper for copying) as EXAMPLE 12 by means of the same ink jet recording apparatus as EXAMPLE 12 so as to produce images. The results of the optical densities of the images produced in this experiment by similar analysis to EXAMPLE 12 are tabulated In Table 7.

COMPARATIVE EXAMPLE 8

With no use of the powder mixture used in EXAMPLE 12, images were produced on the same plain paper (PPC paper for copying) as EXAMPLE 12 by means of the color copying machine (Ricoh Company Ltd.). The results of the optical densities of the images produced in this experiment by similar analysis to EXAMPLE 12 are tabulated in Table 7.

TABLE 7

The Results of the optical densities obtained in EXAMPLEs 12, 13 and COMPARATIVE EXAMPLEs 7, 8. The Optical Densities of The Images

| | Black | | Cyan | | Magenta | | Yellow | |
|---|---|---|---|---|---|---|---|---|
| | Front | Back | Front | Back | Front | Back | Front | Back |
| EXAMPLE 12 | 1.23 | 0.06 | 0.56 | 0.06 | 0.74 | 0.05 | 0.73 | 0.04 |
| EXAMPLE 13 | 1.25 | 0.06 | 0.51 | 0.06 | 0.68 | 0.05 | 0.76 | 0.04 |
| COMPARATIVE EXAMPLE 7 | 1.19 | 0.15 | 0.63 | 0.14 | 0.89 | 0.13 | 0.75 | 0.06 |
| COMPARATIVE EXAMPLE 8 | 1.06 | 0.09 | 0.71 | 0.09 | 1.19 | 0.09 | 0.94 | 0.07 |

EXAMPLE 14

The back surface of the plain paper having the images produced in EXAMPLE 7 was supplied with the liquids by the same method as EXAMPLE 7 so as to form the images on both surfaces of the plain paper. There was no liquid penetration problems on both surfaces, thereby producing vivid images on each surface of the plain paper.

EXAMPLE 15

A mixture of Carbopol ETD2020 and Junron PW-11 (Nihon Junyaku, Trade name) was mixed sufficiently, having a weight ratio of 5:1 by means of the mixer which is commercially available. The powder mixture was then rubbed on a silicone rubber with a coating weight of 0.2 $mg/cm^2$ so as to apply the powder mixture on the rubber, so that the intermediate transfer element for image formation was produced. Liquid images were formed on the silicone rubber by supplying the liquids based on aqueous inks onto the powder mixture by means of the ink jet recording apparatus which is commercially available. Immediately, the liquid images and the powder mixture forming the liquid image on the silicone rubber were transferred to the plain paper by compressing together. During transfer, the only powder mixture forming the liquid images on the silicone rubber was transferred to the recording medium (this transfer is herein referred to as first transfer). In the next place, the powder mixture was re-coated on the silicone rubber. Again, the liquids from the ink jet recording head were supplied on the silicone rubber to produce the liquid images on the rubber, and immediately, compression of the liquid images on the rubber with the plain paper gave transfer images with the same image quality as the images of first transfer (second transfer).

Furthermore, after the first transfer, a residual powder mixture on the silicone rubber was removed completely. Other powder mixture was re-coated on the removed silicone rubber so as to produce a layer of the intermediate transfer element for image formation, and the liquids were supplied by the ink jet recording head to form the liquid images on the silicone rubber. Immediately, the liquid Images on the silicone rubber were transferred to the plain paper by compression together, so that the images were obtained, which images had quality similar to the images produced in first and second transfer steps.

The present invention is not limited to the specifically disclosed preferred embodiments, and variations and modifications may be made without departing from scope of the present invention.

The present application is based on Japanese priority application Nos. 10-327786 filed on Nov. 18, 1998, 10-335079 filed on Nov. 26, 1998, 10-336741 filed on Nov. 27, 1998, the entire contents of which are hereby incorporated by reference.

What is claimed is:

1. A recording method comprising the steps of:

forming a layer of an intermediate transfer element removably on a surface of an intermediate transfer medium in the form of a powder layer, said surface of said intermediate transfer medium formed of a substance that is active relative to said intermediate transfer element, said powder layer being dissolvable and swellable by an ink on said intermediate transfer medium and enabling a viscosity of said ink residing thereon to be increased;

producing an image on said intermediate transfer medium by supplying said ink thereon from a recording head in response to an image signal; and transferring said image to a recording medium, and reusing said intermediate transfer element remaining on said intermediate transfer medium after the step of transferring without being removed from the recording medium.

2. The recording method as claimed in claim 1, further comprising the step of removing an intermediate transfer element having an increased viscosity caused by said ink or absorption of a moisture in air by contacting a cleaning member with said surface of said intermediate transfer medium, a surface of the cleaning member has a poor releasing ability for said intermediate transfer element having said increased viscosity in comparison with said surface of the intermediate medium.

3. The recording method as claimed in claim 1, wherein said cleaning member functions as a transfer roller.

4. The recording method as claimed in claim 1, further comprising the step of transporting a removed intermediate transfer element from said intermediate transfer medium to a collection container; and directing an extra ink or a used ink produced in a recording apparatus into said collection container so as to dispose said ink together with said removed intermediate transfer element.

5. A recording apparatus comprising:

a recording head for projecting an ink;

an intermediate transfer medium;

a recording medium; and a powder layer of an intermediate transfer element formed removably on a surface of said intermediate transfer medium, said surface of said intermediate transfer medium formed of a substance that reacts with said intermediate transfer element, said powder layer being dissolvable and swellable by said ink supplied on said intermediate transfer medium from said recording head in response to an image signal and enabling a viscosity of said ink residing thereon to be increased so as to produce an image which is in turn transferred to said recording medium; and a cleaning member having a surface with poor releasing ability for said intermediate transfer element which has an increased viscosity caused by said ink or absorption of a moisture in air in comparison with said surface of said intermediate transfer medium, and said intermediate transfer element having said increased viscosity is removed from said intermediate transfer medium by contacting a cleaning member with said surface of said intermediate transfer medium after being transferred to said recording medium.

6. A recording method comprising the steps of:

forming a layer of an intermediate transfer element removably on a surface of an intermediate transfer medium, said surface of said intermediate transfer medium formed of a substance that is active relative to said intermediate transfer element, said layer being dissolvable and swellable by an ink on said intermediate transfer medium and enabling a viscosity of said ink residing thereon to be increased;

producing an image on said intermediate transfer medium by supplying said ink thereon from a recording head in response to an image signal; and transferring said image to a recording medium, and reusing said intermediate transfer element remaining on said intermediate transfer medium after the step of transferring without being removed from the recording medium, wherein said cleaning member functions as a transfer roller.

7. A recording apparatus, comprising:

an intermediate transfer medium driven along a circuitous path;

a coating unit coating a surface of said intermediate transfer medium with an intermediate transfer element removably in the form of a powder layer, said intermediate transfer element being formed of a powder substance that is active relative to said intermediate transfer element, said powder substance being dissolvable and swellable by an ink applied to said intermediate transfer medium, said powder substance increasing a viscosity of said ink upon contact with said ink;

a recording head producing an image on said intermediate transfer medium coated with said intermediate transfer element, by supplying thereto said ink in response to an image signal in the form of droplet to form an ink image on said intermediate transfer medium;

a sheet feed mechanism feeding a recording sheet such that said recording sheet is transferred with said ink image from said intermediate transfer medium; and a cleaning member recovering said intermediate transfer element remaining on said intermediate transfer medium after transferring of said ink image to said recording sheet.

8. The recording apparatus as claimed in claim 7, wherein the cleaning member removes an intermediate transfer element having an increased viscosity on said intermediate transfer medium by making a contact with said surface of said intermediate transfer medium, said cleaning member having a poor releasing ability for said intermediate transfer element of increased viscosity in comparison with said surface of the intermediate medium.

9. The recording apparatus as claimed in claim 7, wherein said cleaning member forms a transfer roller.

10. The recording apparatus as claimed in claim 7, further comprising a transportation unit that transports a removed intermediate transfer element from said intermediate transfer medium into a collection container, and wherein said recording head directs an extra ink or a used ink produced into said collection container so as to dispose said ink together with said removed intermediate transfer element.

* * * * *